United States Patent [19]

Leach

[11] 4,011,973

[45] Mar. 15, 1977

[54] CAP SHAPE PRESERVING DEVICE

[76] Inventor: James A. Leach, Box 449 Main St., Ashby, Mass. 01431

[22] Filed: Mar. 26, 1976

[21] Appl. No.: 670,901

[52] U.S. Cl. ..... 223/84; 223/25

[51] Int. Cl.[2] ..... D06C 15/00

[58] Field of Search ..... 2/195, 197; 223/84, 223/24–26

[56] References Cited

UNITED STATES PATENTS

| | | | |
|---|---|---|---|
| 961,418 | 6/1910 | Lloyd | 223/25 |
| 2,704,176 | 3/1955 | Smith | 223/25 |
| 3,459,347 | 8/1969 | Narara | 223/25 |

*Primary Examiner*—G. V. Larkin

*Attorney, Agent, or Firm*—Pearson & Pearson

[57] ABSTRACT

A device for preserving the shape of a visored uniform cap, or the like, is of compact size to fit in pocket of the user. It is formed of at least two elements of rigid material movable longitudinally from pocket length to cap length while held together laterally by one portion seating in an undercut portion of the other. Three rigid, dovetail-slidable, elements permit extension to three times the length of the compacted device. Leaf springs fitting in spaced recesses along the members lock the device at selected lengths. In use the device is at sweat band level within the cap.

10 Claims, 6 Drawing Figures

Fig. 1.
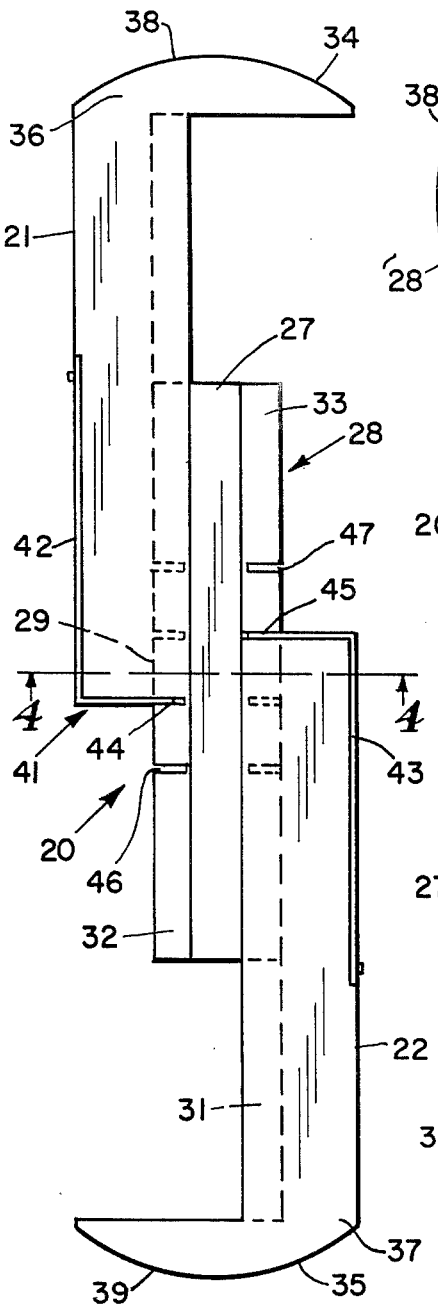
Fig. 2.
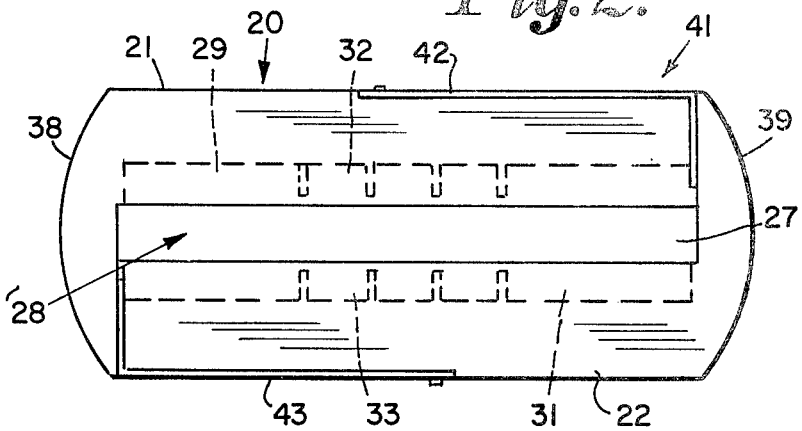
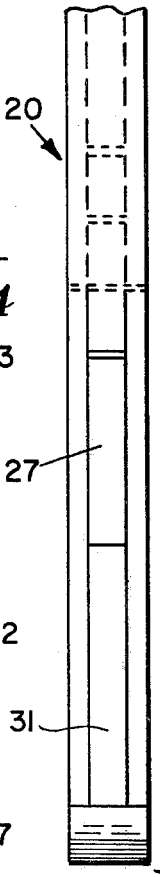
Fig. 3.
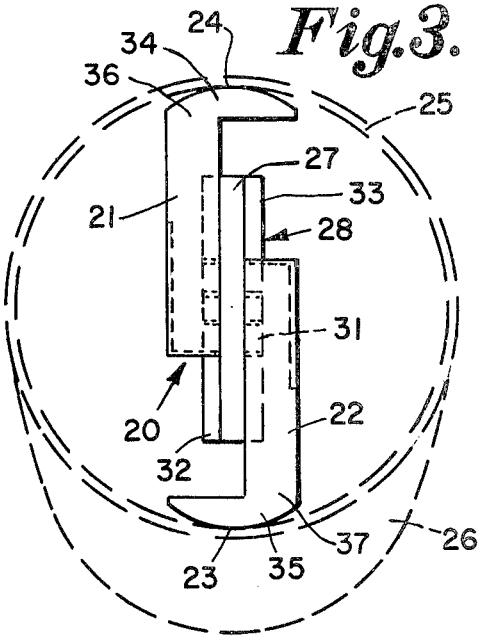
Fig. 4.
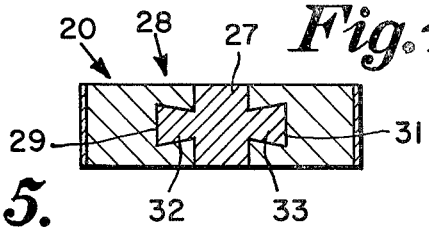
Fig. 5.
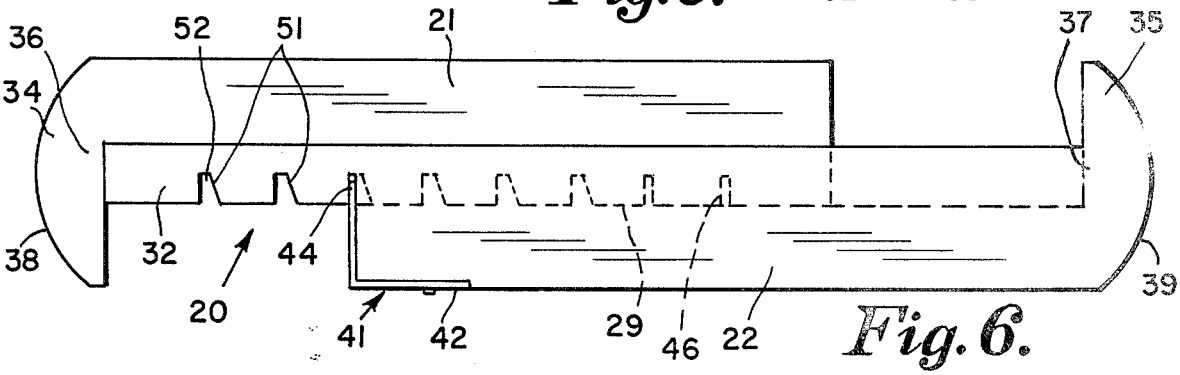
Fig. 6.

CAP SHAPE PRESERVING DEVICE

BACKGROUND OF THE INVENTION

It has heretofore been proposed to provide hat and cap stretchers for maintaining the shape of the crown during the wearing of the head piece. Usually such stretchers have been formed of a resilient metal ring extending around the inside of the top of the crown as in U.S. Pat. No. 1,789,604 to Slutzker of Jan. 20, 1931, U.S. Pat. No. 3,164,842 to Weinstein of Jan. 12, 1965 and U.S. Pat. No. 3,473,168 to Gallin of Oct. 21, 1969.

A similar expandable metal ring, located midway of the height of the crown is disclosed in U.S. Pat. No. 1,577,183 to Dowiarz of Mar. 16, 1926.

Also to be worn in the headpiece while the headpiece is being worn is the turnbuckle expandable attachment shown in U.S. Pat. No. 2,629,873 to Jarosenski of Mar. 3, 1953. The device of this patent is not collapsible to pocket size and while it exerts a stretch at the level of the sweatband the mechanism fills the upper portion of the hat leaving space for the head of the wearer.

SUMMARY OF THE INVENTION

Unlike the above devices of the prior art which are worn with the hat and are not intended to be removable and carried in the pocket, the device of this invention is flat, of uniform thickness when compacted, and fits in the uniform pocket without undue bulge thereof.

Also unlike the prior art devices the cap shape preserving device of the invention is of rigid material, with straight, dovetail groove parts slidable in parallelism for extension from pocket compacted length to two or three such lengths to extend, at sweat band level, from front to back of the cap. When slidably extended to the desired length, the rigid elements are locked in place by laterally movable spring leaf detent mechanism, the tip of the leaf being seated in notches spaced along the slidable member.

BRIEF DESCRIPTION OF THE DRAWING

FIG. 1 is a top plan view of the device of the invention, in extended condition;

FIG. 2 is a view similar to FIG. 1 but with the device in compacted, pocket-size condition;

FIG. 3 is a bottom plan view, similar to FIG. 1, on a reduced scale, showing the device in position within a cap;

FIG. 4 is an enlarged end view in section on line 4—4 of FIG. 1 showing the double dovetail and grooves of a three part device;

FIG. 5 is a fragmentary side view of the device of FIG. 1; and

FIG. 6 is a top plan view of a two part device of the invention.

DESCRIPTION OF A PREFERRED EMBODIMENT

The cap shape-preserving device 20 of the invention includes at least two elongated members 21 and 22, of rigid material such as wood and of predetermined length.

In the embodiment shown in FIG. 6 wherein only two members 21 and 22 are used, the members are both about four to six inches in length, or each about half the distance from the front 23 to the back 24 of the sweatband 25 of a hat or cap 26. In the preferred embodiment shown in FIGS. 1–5 a third elongated member 27 is provided so that the length of each member is about 3 to 4 inches, or about one third the distance from front 23 to back 24 of a sweatband 25.

The elongated members 21, 22 and 27 overlap each other and are in parallelism with each other to form an elongated stretcher element which is of generally uniform thickness and flat to compactly fit in the pocket of a user.

Holding means 28 is provided to enable the elongated members 21, 22 and 27 to slide longitudinally relative to each other, while held to each other laterally, from compacted, pocket-carrying condition, or position, shown in FIG. 2 to expanded cap shape-preserving condition, or position as shown in FIGS. 1, 3 and 6. Holding means 28 preferably comprises a dovetail groove such as at 29 and 31, or similar undercut groove, and a dovetail such as at 32 and 33 or similar equivalent rib and groove slide configuration.

Preferably an enlarged head 34 or 35 is provided at the free terminal end 36 or 37 of each elongated member 21 or 22, the heads projecting in opposite directions, each head having an arcuate curved face 38 or 39 for engaging the sweatband 25 of a visored cap 26.

Latching mechanism 41 is provided preferably comprising a metal leaf spring detent 42 or 43 having a tip 44 or 45 which seats in one of a series of recesses, or notches, 46 or 47, spaced along each dovetail 32 or 33. The tips 44 or 45 are spring biased into a selected recess but the detents may be flexed laterally to unlock the elongated members for relative sliding movement to the desired length. The spring leaf latching means, thus normally locks the device 20 in flat pocket size compacted condition, with the entire device of substantially uniform thickness, but may be unlocked to enter any of the plurality of recesses which expand it to the selected length for preserving the shape of the cap 26. As shown in FIG. 6, a tapered wall 51 may be used on notches 52 to permit the tips 44 or 45 to slip out from notch to notch until the desired expansion is achieved. A spring biased pin operable in a hole could be used as the mechanical equivalent of the tips 44 or 45.

I claim:

1. A cap shape-preserving device adapted to fit compactly in the pocket of the user, said device comprising:

at least two elongated members of rigid material, and of predetermined length, normally overlapping each other in compacted, pocket carrying position;

rib and undercut groove means holding said members together laterally to slide longitudinally upon each other; from said compacted position to expanded cap shape preserving position;

and latching mechanism normally locking said members in said compacted position against relative sliding movement and adapted to lock said members in selected positions of expansion.

2. A device as specified in claim 1 wherein:

each said elongated member is flat, of uniform cross-section and includes an enlarged head at the free terminal end thereof, each said head having an arcuately curved end face for fitting the inside of the sweat band of a cap.

3. A device as specified in claim 1 wherein:

said rib and undercut groove means holding said members together is a dove tail on one said member, fitting a dove tail groove in the other said member.

4. A device as specified in claim 1 wherein:

said latching mechanism comprises a plurality of notches spaced along one side of each said member and a leaf spring detent on each said member, each said detent being spring biased into one of said notches but being distortable out of said notch to enter another said recess.

5. A device as specified in claim 1 wherein:

said device includes a third said elongated member and, said three elongated members overlap and are connected by dovetail and dovetail groove means;

whereby said device occupies only about one third of its expanded cap shape preserving length when slidably compacted to pocket size.

6. A cap shape preserving device comprising:

an elongated stretcher element, of rigid material, and of predetermined length, for fitting in a pocket of the user;

slidable extension means on said element for increasing the length thereof to fit across the sweatband portion of a cap from front to back thereof, rib and undercut groove means retaining said extension means against lateral movement relative to said stretcher element but permitting longitudinal movement therebetween and latching means on said element maintaining said element at said increased length for preserving the shape of said cap when not being worn.

7. A cap shape preserving device as specified in claim 6 wherein:

said slidable extension means includes at least two elongated members overlapping each other, and said rib and undercut groove means comprises dovetail and dovetail groove means.

8. A cap shape preserving device as specified in claim 6 wherein:

said stretcher element includes a pair of heads projecting laterally in opposite directions each at an opposite end thereof; and each having an arcuately curved face and said element is of uniform thickness throughout.

9. A pocket size, visored cap stretcher comprising:

at least two overlapping members of rigid material slidably connected to each other by dovetail and dovetail groove means, said members each having a head with a curved face at the free terminal end thereof and a plurality of recesses spaced therealong and spring leaf latching means on each said member for locking said member in one of the recesses in the other member at selected positions therealong.

10. A pocket size, visored cap stretcher as specified in claim 9 plus:

a third elongated member having dovetail and dovetail groove means thereon, cooperable with the dovetail and dovetail groove means on said two members for relative sliding movement therebetween whereby said stretcher is expandable to substantially three times the length of one of said members.

* * * * *